US005390888A

United States Patent [19]

Rogers

[11] Patent Number: 5,390,888

[45] Date of Patent: Feb. 21, 1995

[54] SUSPENDED HOLDER FOR SUPPORTING A CONTAINER OF PAINT AND BRUSH

[76] Inventor: Wayne A. Rogers, 275 Lakeview Dr., Aurora, Ill. 60506

[21] Appl. No.: 213,548

[22] Filed: Mar. 16, 1994

[51] Int. Cl.[6] ..... A47H 1/10

[52] U.S. Cl. ..... 248/318; 248/110

[58] Field of Search ..... 248/311.2, 313, 110, 248/318, 238, 211, 113; 182/129

[56] References Cited

U.S. PATENT DOCUMENTS

| | | | |
|---|---|---|---|
| 986,660 | 3/1911 | Weathers | 248/110 X |
| 1,551,242 | 8/1925 | Dick | 248/110 X |
| 2,565,315 | 8/1951 | Lieberman | 248/318 |
| 2,686,032 | 8/1954 | Thorson | 248/211 |
| 3,819,140 | 6/1974 | Stewart | 248/313 |
| 3,979,097 | 9/1976 | Balne | 182/129 X |
| 3,980,264 | 9/1976 | Tomasik | 248/110 X |
| 4,919,381 | 4/1990 | Buist | 248/154 |
| 5,035,386 | 7/1991 | Tucker | 248/110 |

FOREIGN PATENT DOCUMENTS

| | | | |
|---|---|---|---|
| 233926 | 5/1925 | United Kingdom | 248/318 |
| 733181 | 7/1955 | United Kingdom | 248/211 |

*Primary Examiner*—J. Franklin Foss
*Attorney, Agent, or Firm*—Milton Gerstein

[57] ABSTRACT

A portable holder a container of paint, and the like, which is capable of being positioned at a multitude of locations on a ladder, or on other structures, which portability allows one to move the supply of paint from one location to another. The holder has it own dedicated, container or receptacle in which paint is poured from a paint can, which receptacle may be releasably latched to the holder itself, whereby the chances of spillage of paint is greatly reduced. The portable holder of the invention is also provided with a vertically-extending hook that is used for suspending the device from a rung of a ladder, or other supporting structure, and a horizontally-extending hook that is used for suspending a paint brush. A stop prevents the horizontally-extending hook from rotating when the vertically-extending hook rotates. The main frame of the portable holder for a paint container of the invention is a generally open structure, so that the paint in the dedicated receptacle, or other container supported on the lower shelf thereof, may be readily and facilely accessed from almost a full 360 degree orientation about the receptacle and thereabove.

17 Claims, 3 Drawing Sheets

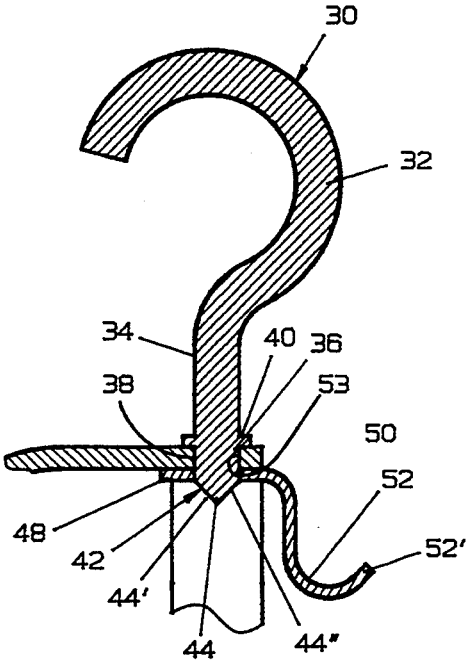
FIG. 7
FIG. 8
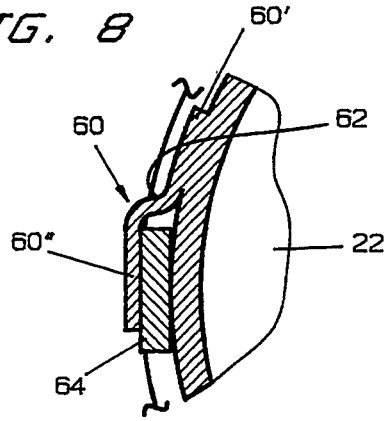
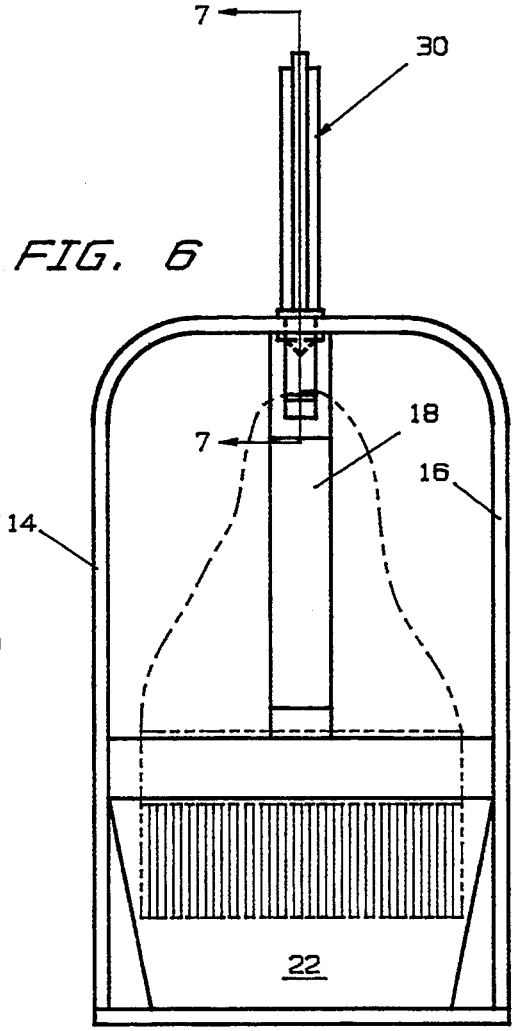
FIG. 6
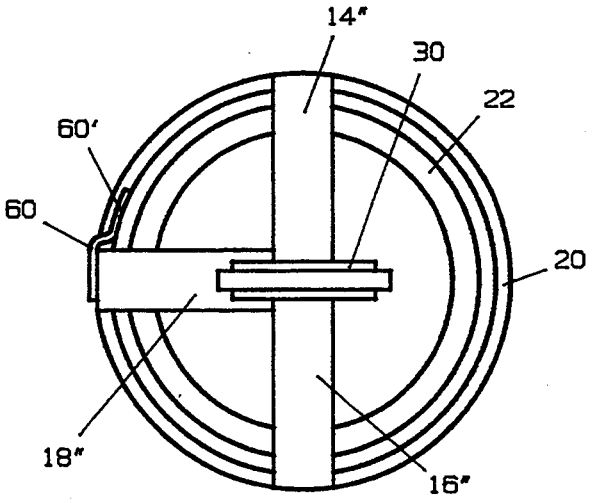
FIG. 5

SUSPENDED HOLDER FOR SUPPORTING A CONTAINER OF PAINT AND BRUSH

BACKGROUND OF THE INVENTION

The present invention is directed to a holder, or support, for a container that is filled with paint, varnish, and the like, that is ready to be applied to a surface. The holder of the invention is especially intended for suspension from a rung of a ladder, so that a container of paint that is supported thereon may be readily accessible to a painter while he is standing on any rung of the ladder.

It is generally known that in the process of painting a wall, a house, and the like, one must ascend a ladder in order to reach different elevations. Typically, a conventional ladder has a pivotal shelf, or support, that is used for supporting a paint can or paint-roller pan thereon. This shelf is usually located near the top of the ladder. Thus, when a painter is located at a lower one of the rungs of the ladder, access to the paint can on the shelf is made more difficult, and requires that the painter reach up, or sometimes partially climb up, the ladder, in order to access the paint in the paint can or paint-roller pan. The pivotal shelf also has the considerable disadvantage of not retaining the paint can or pan firmly in place. Thus, if the painter is not careful, the paint or paint-roller pan could fall from off the pivotal shelf.

It would, therefore, be highly advantageous to provide a device or product that would allow continual repositioning of a support for a container of paint, and the like, which retains it firmly in place.

SUMMARY OF THE INVENTION

It is, therefore, the primary objective of the present invention to provide a portable support for a container of paint, and the like, which is capable of being positioned at a multitude of locations on a ladder, or on other structures, which portability allows one to move the supply of paint from one location to another, as he, or she, changes the location required to be painted.

It is another objective of the present invention to provide such a portable support, or holder, which is provided with its own, dedicated, container or receptacle in which paint is poured from a paint can, which receptacle may be releasably latched to the holder itself, whereby the chances of spillage of paint is greatly reduced.

Toward these, and other ends, the portable holder for a paint container, can, and the like, of the invention is provided with a main frame having a lower, horizontal support-shelf for supporting a paint can of paint thereon, and, in the preferred embodiment of the invention, for supporting a dedicated receptacle which stores paint, and the like, poured therein from a primary source, such as a paint can. The dedicated receptacle has a latch that cooperates with a retainer on the main housing, in order to retain the receptacle in place, to thereby minimize the chances of spillage.

The portable holder for a paint container of the invention is also provided with a vertically-extending hook that is used for suspending the device from a rung of a ladder, or other supporting structure. The main frame also has a horizontally-extending hook that is used for suspending a paint brush. The main frame of the portable holder for a paint container of the invention is a generally open structure, so that the paint in the dedicated receptacle, or other container supported on the lower shelf thereof, may be readily and facilely accessed from almost a full 360 degree orientation about the receptacle and thereabove. Such an open structure is achieved by the provision of only three vertical brace-members projecting upwardly from the top surface of the lower shelf, which brace-members are spaced apart 90 degrees, in order to leave open a front, arcuate expanse of 180 degrees. The brace-members are relatively narrow in width, so that access to the paint may also be had between any two adjacent, vertical brace-members, as well as from thereabove. The three brace-members meet at an upper elevation by means of three, joining, horizontal leg-sections. Since two of the brace-members are oriented 180 degrees from each other, the two horizontal leg-sections associated therewith form one, integral, horizontal member, which is, also, used for rotatably supporting the vertical-extending hook.

BRIEF DESCRIPTION OF THE DRAWING

The invention will be more readily understood with reference to the accompanying drawing, wherein:

FIG. 5 is a top view thereof;

FIG. 6 is a rear view thereof;

FIG. 7 is a cross-sectional view taken along line 7—7 of FIG. 6;

FIG. 8 is a cross-sectional view taken along line 8—8 of FIG. 2.

DETAILED DESCRIPTION OF THE INVENTION

Figure 1:
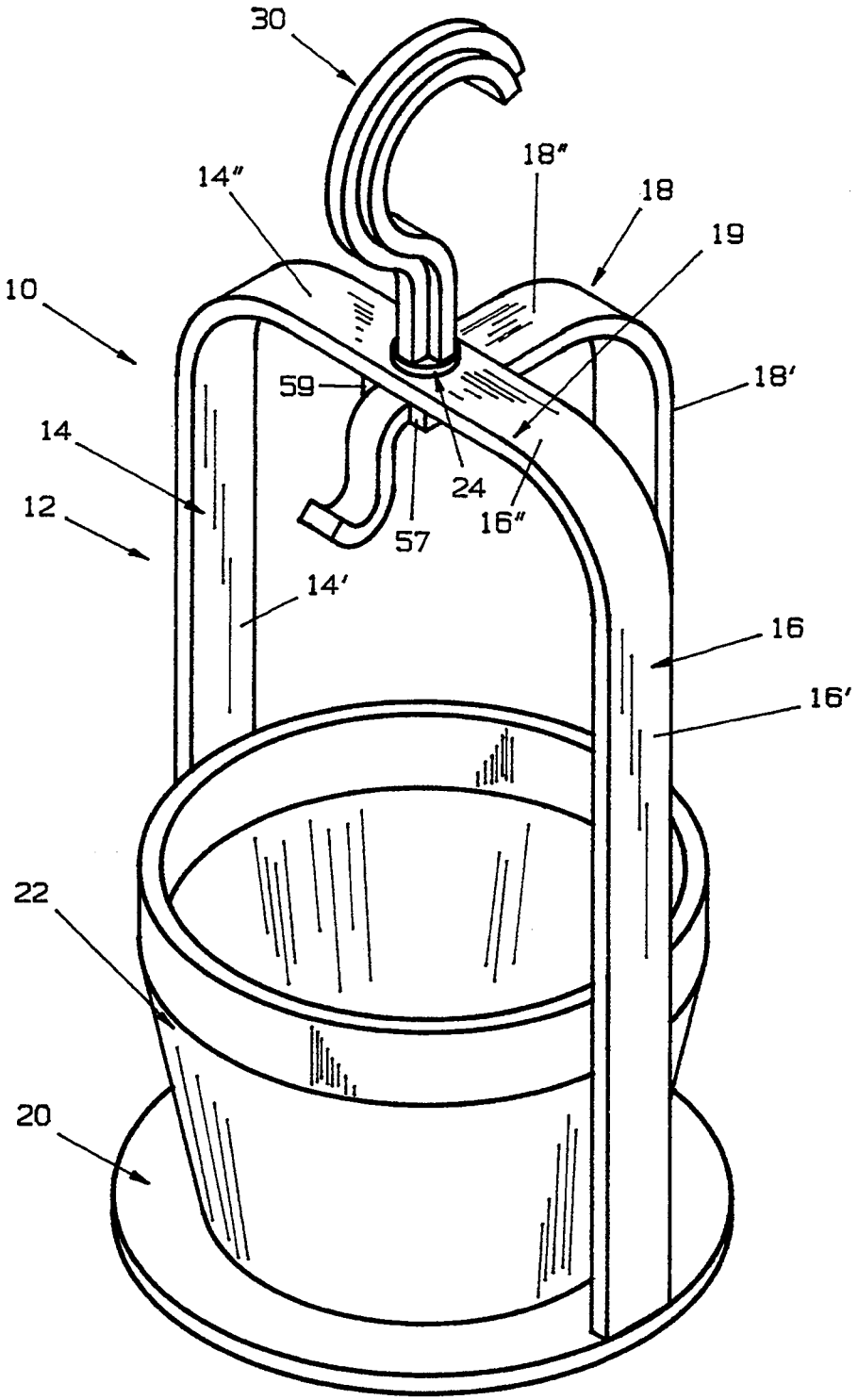
FIG. 1 is an isometric view showing the portable support for a container of paint, and the like, of the invention.
Figure 2:
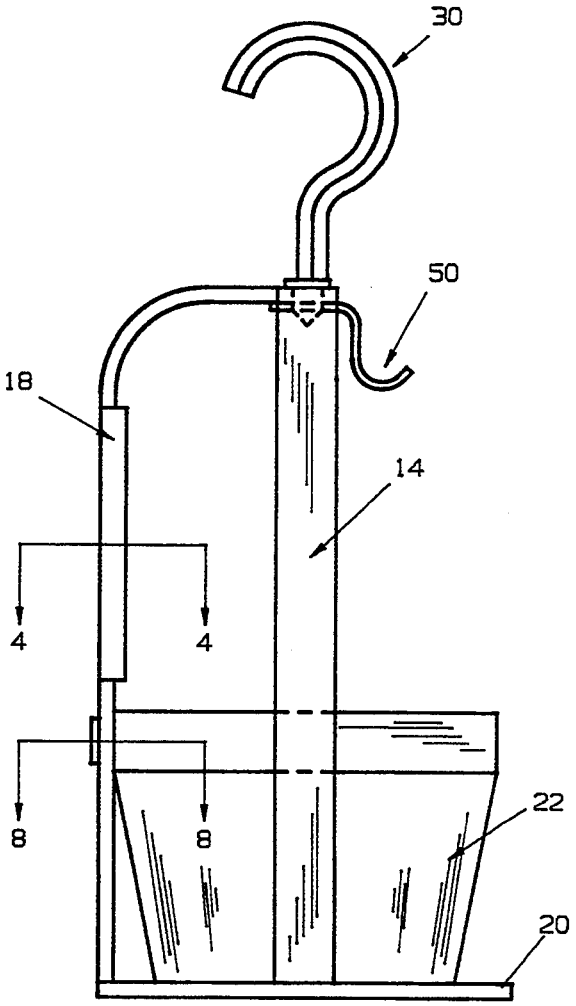
FIG. 2 a side elevationai view thereof.
Figure 3:
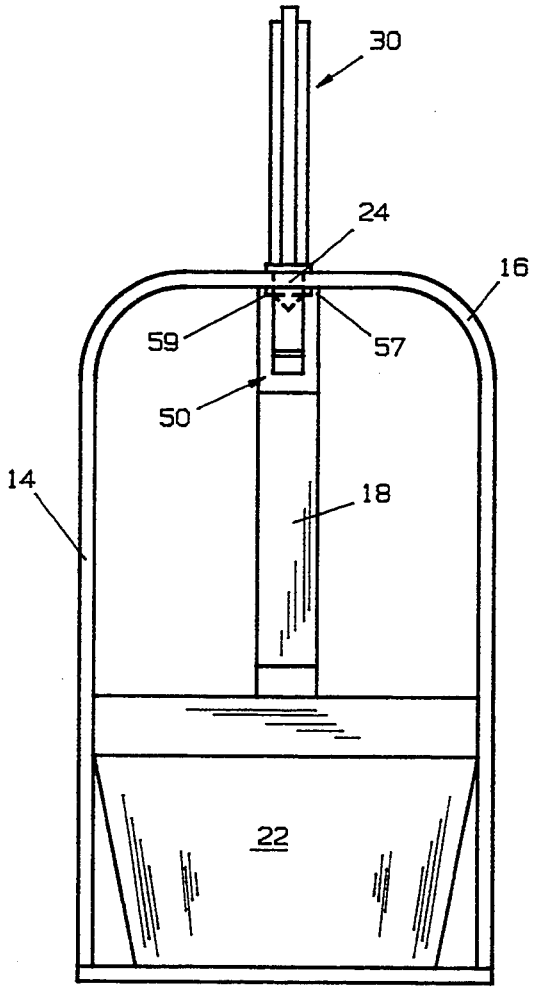
FIG. 3 is a front view thereof.

Referring now to the drawing in greater detail, the suspended support, or holder, for a container that is filled with paint is indicated generally by reference numeral 10. The holder 10 has a main frame 12 consisting of three vertical, relatively-narrow, spaced-apart brace-members 14, 16 and 18. Each brace-member consists of a vertical leg-section 14', 16', 18', respectively, and an upper, horizontal leg-section 14'', 16'', 18'', respectively. Each respective, vertical leg-section 14', 16', 18', and its respective upper, horizontal leg-section 14'', 16'', 18'', meet an upper, arcuate transition region, as clearly seen in FIG. 1, in order to provide increased structural integrity, as well as for aesthetic appeal, and in order to provide a convenient handle for gripping and carrying the device 10 by any of the brace-members, which gripping may be enhanced by the provision of a knurled surface, or the like. Preferably, an upper portion of brace-member 18 is widened, as seen in FIGS. 2, 3 and 6, in order to serve as a handle. The brace-members are spaced 90 degrees apart, in order to aid in the ease of gripping one of the brace-members, and so that there is an arcuate distance of 180 degrees between brace-members 14 and 16, which allows for easy accessing to the interior of the main frame, in order to access paint. The bottom ends of the three brace-members 14, 16, 18 mount a circular, or other-shaped support-shelf 20, which is used for supporting thereon a dedicated, or other, container or receptacle 22, which receptacle 22 has a store of paint, varnish, and the like, therein. The upper, horizontal leg-sections 14'', 16'', 18'' meet at a central location 24, which is substantially aligned with the center of the bottom support-shelf 20. Since the two upper, horizontal leg-sections 14'', 16'' are coextensive, together they form one, elongated and continuous upper horizontal member 19, as seen in FIG. 1. Fixedly joined to a side edge-surface of this elongated and continuous upper horizontal member 19, is the free end of the upper horizontal leg-section 18'', as seen in FIGS. 2 and 3, whereby all of the ends of the horizontal leg-sections are substantially coplanar. The upper, horizontal member 19 rotatably mounts a vertical hook-member 30, which is best seen in FIGS. 1, 2, and 7. The hook-member 30 consists of an upper, hook-shaped element 32, which is used for suspending the device from a rung of a ladder, or other supporting surface. Extending downwardly from the hook-shaped element, is a vertical mounting shaft 34, which is provided with a lower, circular, integral mounting sleeve, or bushing 36, which is rotatable within an opening 38 formed in the upper horizontal member 19 at the central location 24. The bushing 36 has an enlarged, upper, circular flange or retaining ring 40, and an enlarged, lower, circular flange or retaining ring 42. The lower circular flange or retaining ring 42 is defined by a conically-shaped section 44 which allows for the mounting of the hook-member 30 through the opening 38 by forcing the lower conically-shaped section 44 therethrough, with the canted sides 44', 44'' camming out the interior surface of the opening, achieving thereby a snap-fit. The conically-shaped section 44 is also forced through a through-opening of a shank 48 of a second, horizontal hook-member 50, which hook-member 50 defines a V-shaped extension 52 for suspending a paint brush. The V-shaped extension 52 has an outermost leg 52' which is passed through a hole 53 in the shank of a paint brush, shown in dotted lines in FIG. 6, to thereby suspend the brush. Thus, the overall length of the bushing 36 between the two annular flanges 40, 42 is great enough in order to pass through both openings 38 and 53, which two opening are in linear alignment. The hook-member 30 is allowed free rotation relative to the main frame 12, so that one may rotate the main frame until, preferably, the open, 180-degree arcuate-side of the main frame 12, defined between the two brace-members 14, 16, is opposite him, to thereby allow easy and unobstructed access to the stored paint. The two hook-members 30 and 50 are preferably made as one unit of two, separable parts, and may be used in other environments and with other devices, where a vertical hook is desirable for suspending the device, and the horizontal hook is used for suspending work items, or the like. A pair of downwardly-projecting, horizontally-spaced apart stop-members 57, 59 are provided on the underside of the horizontal member 19, as best seen in FIG. 1, adjacent to, and sandwiching therebetween, the lateral side edge-surfaces of the hook-member 50, whereby the hook-member 50 is prevented from rotating when the vertical hook-member 30 is rotated. The horizontal hook-member 50 is of great importance, since when it suspends a paint brush, the bristles of the paint brush are immersed in the paint contained in the container therebelow. This ensures that the bristles do not dry out, and obviates the need for the cleaning the bristles of the brush. In addition, supporting the brush in this fashion, prevents the brush from moving about as the paint container is moved from one location to the another, and helps to prevent the handle of the paint brush from being stained or soaked in paint, thus making for a considerably cleaner situation. The hook-member 50 also provides a readily-accessible and convenient location for storing the paint brush when not being used, and, also, frees one hand, since when moving from one location to another, transportation of the paint container in one hand also automatically transports with it the associated paint brush.

Figure 4:
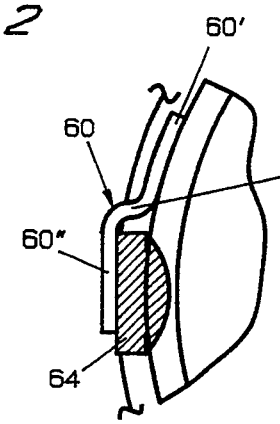
FIG. 4 is a cross-sectional view taken along line 4—4 of FIG. 2.

As previously described, in the preferred embodiment, there is provided a dedicated receptacle, or container, holder into which paint from a paint can, or the like, is poured, for storage therein. The container 22 has a generally circular cross section to match that of the bottom support-shelf 20. The container 20 also has an outer taper, as seen in FIG. 2, to define a frustoconical-shaped profile. The upper rim 22' of the container 22 is enlarged or widened, as seen in FIG. 1. To the rear of this widened rim, there is provided a flexible, horizontally-disposed, latching arm 60, as best seen in FIGS. 4, 5 and 8. The latching arm 60 is preferably made as one-piece with the rim of the container, and has a first, elongated securing section 60' affixed to the rim 22' and a free, cantilevered section 60'' connected to the end of the first securing section by means of a stepped, transition region 62. This stepped transition region gives the cantilevered section 60'' enough flexibility and elasticity so that it may be pushed away from the rim 22' in order to receive therein a portion of the rear, vertical brace-member 18. When viewing FIG. 1, after the container 22 has been placed on the support-shelf 20, the container is rotated in the counter-clockwise direction until the cantilevered latching section 60'' is forced out by the juxtapositioned section of the vertical brace-member 18. With further rotation, the latching section 60'' is firmly retained against this juxtapositioned section of the vertical brace-member 18, whereby the container 22 is firmly, yet releasably, held in place on the support-shelf 20, in order to reduce the chances of accidental spillage.

In the preferred embodiment, the main frame, including the three brace-member and the bottom supporting shelf are made of one-piece of injection-molded, thermoplastic resin, with each of the hook-members also being a one-piece, injection-molded, thermoplastic resin. While the preferred embodiment has disclosed the use of the dedicated container or receptacle, it is, of course, possible to support on the bottom support-shelf a standard paint can or paint-roller pan, and the like. Moreover, while the preferred embodiment has been disclosed for use of the invention in conjunction with paint, and the like, and paint brushes, it is possible to use the invention in other environments where it would be advantageous to allow for the portable support of a frequently-used item. For example, the device of the invention could be used by builders, tradesmen, carpenters, and the like, where instead of paint being stored in the receptacle, other frequently-used items would be stored therein, such as screws, nuts, etc., especially when there is the need to perform work on a ladder or at an elevated position.

While a specific embodiment of the invention has been shown and described, it is to be understood that numerous changes and modifications may be made therein without departing from the scope, spirit and intent of the invention as set forth in the claims.

What is claimed is:

1. A holder for supporting a container, comprising:

a main frame having a bottom support-shelf for supporting a container, or the like, thereon;

said main frame having a plurality of vertical, spaced-apart brace-members, each said brace member having a bottom end to which is secured said bottom support-shelf; and a hook-member projecting upwardly from said main frame for suspending said main frame from a support;

each of said brace-members comprising a vertical leg-section having a lower end and an upper end, and a horizontal leg-section extending from the upper end of said vertical leg-section; said horizontal leg-sections meeting at a central location; said hook-member being mounted at said central location to at least one of said horizontal leg-sections.

2. The holder according to claim 1, wherein said plurality of brace-members are at least two in number, two of said brace-members being adjacent to each other and spaced approximately 180 degrees apart, in order to allow easy access to a container supported on said support-shelf; each of said brace-members also serving as a handle by which the holder may be gripped and carried.

3. The holder according to claim 1, wherein two of said brace-members are adjacent to each other and spaced approximately 180 degrees apart, in order to allow easy access to a container supported on said support-shelf; said horizontal leg-sections of said two brace-members being connected to form a one-piece, elongated section; said central section being defined at the central portion of said one-piece, elongated section, said hook-member being mounted to said central portion of said one-piece, elongated section.

4. The holder according to claim 3, wherein there are at least three said brace-members, a third said brace-member being arcuately, equidistantly located between said two brace-members.

5. The holder according to claim 4, wherein said horizontal section of said third brace-member is secured to a side edge-surface of said one-piece, elongated section, whereby the ends of said horizontal sections are substantially coplanar.

6. The holder according to claim 1, wherein said hook member comprises a hook-element, a shaft extending from said hook-element, and means for rotatably mounting said shaft at said central location.

7. The holder according to claim 6, wherein said mean for rotatably mounting comprises a through-opening formed in said at least one of said horizontal leg-sections for passing therethrough a portion of said shaft; said shaft comprising a first, upper limit member and a second lower limit member for preventing said shaft from escaping said through-opening.

8. The holder according to claim 1, further comprising another hook-member mounted below said hook-member; said another hook-member comprising a hole therein; said hook-member comprising a hook-element, and a shaft; said central location having a through-opening formed therethrough, in linear alignment with said hole of said another hook-member, for passing a portion of said shaft. therethrough; said shaft of said hook-member passing through both said through-opening and said hole; said shaft having retaining means for preventing said shaft from escaping said hole and said through-opening; and means for preventing the rotation of said another hook-member when said hook-member is rotated.

9. The holder according to claim 1, further comprising a container for storing liquid, or the like therein, said container being supported on said support-shelf.

10. The holder according to claim 9, said container comprising retaining means for releasably securing said container to said main frame.

11. The holder according to claim 10, wherein said container comprises an outer circumferential surface, said retaining means comprising a detent member on a portion of said outer circumferential surface, said detent member cooperating with a portion of one of said brace-members for releasably securing said container to said main frame.

12. The holder according to claim 11, wherein said detent member comprises a flexible finger having a first section fixedly secured to said portion of said outer circumferential surface, and a second, cantilevered section defining a free end, whereby said portion of one of said brace-members is received in the space between said second, cantilevered section and the portion of said outer circumferential surface juxtapositioned thereat, for releasably retaining said container in place.

13. A holder for supporting a container, comprising:

a main frame having a bottom support-shelf for supporting a container, or the like, thereon;

said main frame having at least one vertical, brace-member having a bottom end to which is secured said bottom support-shelf; and a container for storing liquid, or the like therein, said container being supported on said support-shelf;

said container comprising retaining means for releasably securing said container to said main frame;

said container comprising an outer circumferential surface, said retaining means comprising a detent member on a portion of said outer circumferential surface, said detent member cooperating with a portion of said brace-member for releasably securing said container to said main frame.

14. The holder according to claim 13, wherein detent member comprises a flexible finger having a first section fixedly secured to said portion of said outer circumferential surface, and a second, cantilevered section defining a free end, whereby said portion of said brace-member is received in the space between said second, cantilevered section and the portion of said outer circumferential surface juxtapositioned thereat, for releasably retaining said container in place.

15. A holder for supporting a container of paint and the like, comprising:

a main frame having a bottom support-shelf for supporting a container of paint, and the like, thereon;

said main frame having at least one vertical wall-member, said at least one wall-member having a bottom end to which is secured said bottom support-shelf; and a substantially horizontal hook-member projecting from a portion of said main frame for suspending a brush;

a container of paint, and the like, supported on said bottom shelf; said hook-member being located vertically above said container; and a paint brush having a handle section and bristles, said hook-member suspending said paint brush from said handle-section, said bristles being immeresed in said container of paint so that said bristles do not dry out.

16. A holder for supporting a container, comprising:

a main frame having a bottom support-shelf for supporting a container, or the like, thereon;

said main frame having a plurality of vertical, spaced-apart brace-members, each said brace member having a bottom end to which is secured said bottom support-shelf; and a hook-member projecting upwardly from said main frame for suspending said main frame from a support;

a container for storing liquid, or the like therein, said container being supported on said support-shelf;

said container comprising retaining means for releasably securing said container to said main frame;

said container comprising an outer circumferential surface, said retaining being located on a portion of said outer circumferential surface, said retaining means member cooperating with a portion of one of said brace-members for releasably securing said container to said main frame.

17. The holder according to claim 16, wherein said retaining means comprises a flexible finger having a first section fixedly secured to said portion of said outer circumferential surface, and a second, cantilevered section defining a free end, whereby said portion of one of said brace-members is received in the space between said second, cantilevered section and the portion of said outer circumferential surface juxtapositioned thereat, for releasably retaining said container in place.

* * * * *